US009567763B2

(12) United States Patent
Miyazawa et al.

(10) Patent No.: US 9,567,763 B2
(45) Date of Patent: Feb. 14, 2017

(54) VIBRATION DAMPING WALL STRUCTURE AND A METHOD OF CONNECTING VIBRATION DAMPING DEVICES

(71) Applicants: Kenji Miyazawa, Hino (JP); SATOH CO., LTD., Kunitachi-shi (JP); DOMUS ARCHITECT OFFICE CO., LTD., Musashino-shi (JP)

(72) Inventors: Kenji Miyazawa, Hino (JP); Shuichi Satoh, Kunitachi (JP); Isao Okawa, Akishima (JP)

(73) Assignees: Kenji Miyazawa, Tokyo (JP); SATOH CO., LTD., Tokyo (JP); DOMUS ARCHITECT OFFICE CO., LTD., Tokyo (JP)

( * ) Notice: Subject to any disclaimer, the term of this patent is extended or adjusted under 35 U.S.C. 154(b) by 31 days.

(21) Appl. No.: 14/679,273

(22) Filed: Apr. 6, 2015

(65) Prior Publication Data

US 2016/0244966 A1 Aug. 25, 2016

(30) Foreign Application Priority Data

Dec. 26, 2014 (JP) ..... 2014-264563
Feb. 19, 2015 (JP) ..... 2015-030669

(51) Int. Cl.
*E04H 9/02* (2006.01)
*E04B 1/98* (2006.01)

(52) U.S. Cl.
CPC ..... *E04H 9/02* (2013.01); *E04B 1/985* (2013.01)

(58) Field of Classification Search
CPC ..... E04H 2009/026; E04H 9/00; E04H 9/02; E04H 9/024; E04H 9/027; E04H 9/028; E04B 1/98; E04B 1/985
(Continued)

(56) References Cited

U.S. PATENT DOCUMENTS 5,271,197 A * 12/1993 Uno ..... E04H 9/02 52/167.1
5,904,025 A * 5/1999 Bass ..... E04G 23/0218 52/167.3
(Continued)

FOREIGN PATENT DOCUMENTS

JP 01318629 A * 12/1989
JP 02221560 A * 9/1990
(Continued)

*Primary Examiner* — Brent W Herring
(74) *Attorney, Agent, or Firm* — Kratz, Quintos & Hanson, LLP

(57) ABSTRACT

A robust vibration damping device not suffering from destruction even when an earthquake force is increased.

A vibration damping wall structure includes a structural frame comprising a foundation, a beam, and vertical members. One set of vibration damping devices are attached to a first vertical member, and another set of vibration damping devices are attached at positions respectively opposing the one set of vibration damping devices to a second vertical member. Each of the vibration damping devices is connected with the vertical member by way of a brace. The vibration damping devices in the one set and opposing vibration damping devices in another set are connected each other in a lateral direction by lateral connection members between each of the sets. Further, the vibration damping devices of each of the sets are connected each other in a vertical direction by the vertical connection members respectively in each of the sets.

8 Claims, 11 Drawing Sheets

(58) Field of Classification Search
USPC ..... 52/167.1, 167.3, 167.4, 167.7, 167.8
See application file for complete search history.

(56) References Cited

U.S. PATENT DOCUMENTS

| | | | | |
|---|---|---|---|---|
| 6,226,935 | B1 * | 5/2001 | Kuramochi | E04H 9/02 52/167.1 |
| 6,308,469 | B1 * | 10/2001 | Leung | E04B 1/10 411/466 |
| 6,397,528 | B1 * | 6/2002 | Rahimian | E04H 9/02 52/167.1 |
| 6,412,237 | B1 * | 7/2002 | Sahai | E04H 9/02 52/167.1 |
| 6,920,724 | B1 * | 7/2005 | Hundley | E04B 1/24 52/167.3 |
| 7,712,266 | B2 * | 5/2010 | Sarkisian | E04H 9/02 52/167.1 |
| 9,080,339 | B2 * | 7/2015 | Hayes | F16B 7/00 |
| 2002/0046514 | A1 * | 4/2002 | Leung | E04B 1/10 52/167.3 |
| 2002/0129568 | A1 * | 9/2002 | Oka | E04H 9/02 52/167.3 |
| 2002/0162285 | A1 * | 11/2002 | Sahai | E04H 9/02 52/167.7 |
| 2006/0150538 | A1 * | 7/2006 | Thomas | E04H 9/02 52/167.3 |
| 2006/0179729 | A1 * | 8/2006 | Li | E04H 9/02 52/167.7 |
| 2008/0289267 | A1 * | 11/2008 | Sarkisian | E04H 9/02 52/167.3 |
| 2010/0186317 | A1 * | 7/2010 | Kirsten | A47B 47/0008 52/167.8 |
| 2010/0192485 | A1 * | 8/2010 | Sarkisian | E04H 9/02 52/167.3 |
| 2012/0038091 | A1 * | 2/2012 | Tagawa | E04H 9/021 267/136 |
| 2014/0259993 | A1 * | 9/2014 | Hayes | F16B 7/00 52/167.1 |
| 2015/0308106 | A1 * | 10/2015 | Hayes | F16B 7/00 52/167.1 |

FOREIGN PATENT DOCUMENTS

| | | | | |
|---|---|---|---|---|
| JP | 2000-110400 | | | 4/2000 |
| JP | 2001-207679 | A1 | | 8/2001 |
| JP | 2003-106006 | A1 | | 4/2003 |
| JP | 2004-225309 | A1 | | 8/2004 |
| JP | 2006-63771 | A1 | | 3/2006 |
| JP | 2006-307527 | A1 | | 11/2006 |
| JP | 2007-46410 | A1 | | 2/2007 |
| JP | 2007-332575 | A1 | | 12/2007 |
| JP | 2008-308911 | A1 | | 12/2008 |
| JP | 2009-275473 | A1 | | 11/2009 |
| JP | 2009275473 | A | * | 11/2009 |
| JP | 2011-32777 | A1 | | 2/2011 |
| JP | 2013-19233 | A1 | | 1/2013 |
| JP | 2013019233 | A | * | 1/2013 |
| JP | 2015-28243 | A1 | | 2/2015 |

* cited by examiner

VIBRATION DAMPING WALL STRUCTURE AND A METHOD OF CONNECTING VIBRATION DAMPING DEVICES

CROSS-REFERENCE TO RELATED APPLICATIONS

The disclosure of Japanese Patent Application No. 2015-030669 filed on Feb. 19, 2015 including the specification, drawings, and abstract is incorporated herein by reference in its entirety.

BACKGROUND OF THE INVENTION

Field of the Invention

The present invention relates to a structure for a vibration damping wall mainly used in wooden buildings or steel structure buildings for reducing an earthquake force that exerts on buildings to improve the horizontal capacity of structural frames, as well as a method of connecting vibration damping devices.

Description of the Related Art

Techniques relating to vibration damping devices installed to structural frames of buildings and techniques relating to methods of connecting the vibration damping devices and the structural frame for preventing buildings from destruction upon occurrence of huge earthquake have been provided so far (refer to JP-A No. 2009-275473).

FIG. 6 and FIG. 7 illustrate a vibration damping device and a method of connecting vibration damping devices and a structural frame shown in JP-A No. 2009-275473 of a building. FIG. 6 illustrates a structure frame 60 of a building. The structural frame 60 comprises a foundation 61, a beam 62 and vertical members 63 (first vertical member 63*a* and a second vertical member 63*b*). A first vibration damping device 70*a* is attached about at the midway of a first vertical member 63*a* by fixing means such as bolts or screws and a second vibration damping device 70*b* is attached about at the midway of a second vertical member 63*a* by fixing means such as bolts or screws.

Corner fittings 71 are fitted each by way of fixing means such as bolts or screws at four corners defined by the first vertical member 63*a* and the second vertical member 63*b*, the foundation 61, and the beam 62. The four corner fittings 71 and the vibration damping devices 70*a* and 70*b* are connected in an X-form by brace members 72 such as steel pipe brace members as illustrates in FIG. 7.

The vibration damping device 70 is usually in a state as illustrated in FIG. 8A and, when an earthquake occurs, the lateral sides 73 expand or contract by the deformation of bend portions of the vibration damping device 70 as illustrated in FIGS. 8B and 8C due to earthquake shaking. Then, the earthquake energy is decayed by repeating expansion/contraction to absorb swaying of an entire building structure and prevent the building from destruction.

SUMMARY OF THE INVENTION

Destruction of a building can be prevented effectively by installing the vibration damping devices 70 to the vertical members 63 and connecting them by brace members 72 as described above.

However, along with reinforcement and scale enlargement of structural materials in recent years, their fixed loads have been increased. Thus, a shaking force due to the earthquake that exerts on the structural frame 60 of the building has been increased and the force exerting on the vibration damping device 70 has also been increased compared with existent cases. Accordingly, in a state of FIG. 8B, the upper lateral side 73 contracts more largely than usual and the lower lateral side 73 extends more largely than usual. In a state of FIG. 8C, the upper lateral side extends more largely than usual and the lower lateral side 73 contracts more largely than usual. When such large expansion and contraction repeat, the bending stress on the lateral sides 73 exceeds a limit and plastic cracks are generated to damage the vibration damping device 70. Then, the vibration damping device 70 no more functions, which may possibly destroy the building finally.

The present invention intends to solve such a problem and provide a vibration damping wall structure and a method of connecting the vibration damping devices, not leading to destruction of the building even when the earthquake force increases.

In order to solve the subject, the present invention intends to provide a vibration damping wall structure including;

a plurality of first vibration damping devices attached to a first vertical member that constitutes a structural frame of a building, a plurality of second vibration damping devices attached to a second vertical member that constitutes the structural frame so as to oppose the first vibration damping devices, a first brace member for connecting the first vertical member and the second vibration damping devices, a second brace member for connecting the second vertical member and the first vibration damping devices, lateral connection members for connecting the first vibration damping devices and the second vibration damping devices opposing thereto, a first vertical connection member for connecting the plurality of the first vibration damping devices to each other, and a second vertical connection member for connecting the plurality of the second vibration damping devices to each other.

In the vibration damping wall structure of the present invention, the plurality of the first vibration damping devices attached to the first vertical member that constitutes the structural frame of the building and the plurality of the second vibration damping devices attached to the second vertical member that constitutes the structural frame so as to oppose the first vibration damping devices are connected by the lateral connection members and the vertical connection members.

Thus, earthquake shaking is transferred uniformly from the vertical members by way of the brace members and the lateral connection members and the vertical connection members to the vibration damping devices.

For solving the subject described above, the present invention also provides a method of connecting vibration damping devices of connecting a plurality of first vibration damping devices attached to a first vertical member that constitutes a structural frame of a building and a plurality of second vibration damping devices attached to a second vertical member that constitutes the structural frame so as to oppose the first vibration damping devices, the method including:

connecting the first vertical members and the second vibration damping devices by a first brace member, connecting the second vertical member and the second vibration damping devices by a second brace member, connecting the first vibration damping devices and the second vibration damping devices opposing the first vibration damping devices by lateral connection members, connecting the plurality of the first vibration damping devices to each other by the first vertical connection member and connecting the plurality of the second vibration damping devices to each other by the second vertical connection member.

In the method of connecting the vibration damping devices of the present invention, the plurality of the first vibration damping devices attached to the first vertical member that constitutes the structural frame of the building and the plurality of the second vibration damping devices attached to the second vertical member that constitutes the structural frame so as to oppose the first vibration damping devices are connected by the lateral connection members and the vertical connection members.

Thus, earthquake shaking is transferred from the vertical member by way of the brace member and the lateral connection member and the vertical connection member uniformly to all of the vibration damping devices.

According to the present invention, the earthquake shaking is transferred from the vertical members by way of the brace members and the lateral connection members and the vertical connection members to all of the vibration damping devices. In this condition, since deleterious deformation of the upper plane of the vibration damping device is restricted by the lateral connection members and the vertical connection members, expansion and contraction in the direction of the height of the lateral side is decreased to reduce the burden on the lateral bend portion 74.

Thus, plastic cracks are not generated on the lateral side of the vibration damping device, and the vibration damping device does not suffer from damages and deformation of the structural frame of the building can be reduced finally. That is, by the new method of connecting the vibration damping devices and the brace members, the lateral connection members, and the vertical connection members, since they are operationally associated and restrict the swaying by earthquake, the remarkable effect described above can be provided (this is to be described specifically in preferred embodiments).

DESCRIPTION OF THE ACCOMPANYING DRAWINGS

DETAILED DESCRIPTION OF PREFERRED EMBODIMENTS

First Embodiment

A first embodiment describes an example of a vibration damping wall structure and a method of connecting vibration damping devices in a wooden building.

Figure 1:
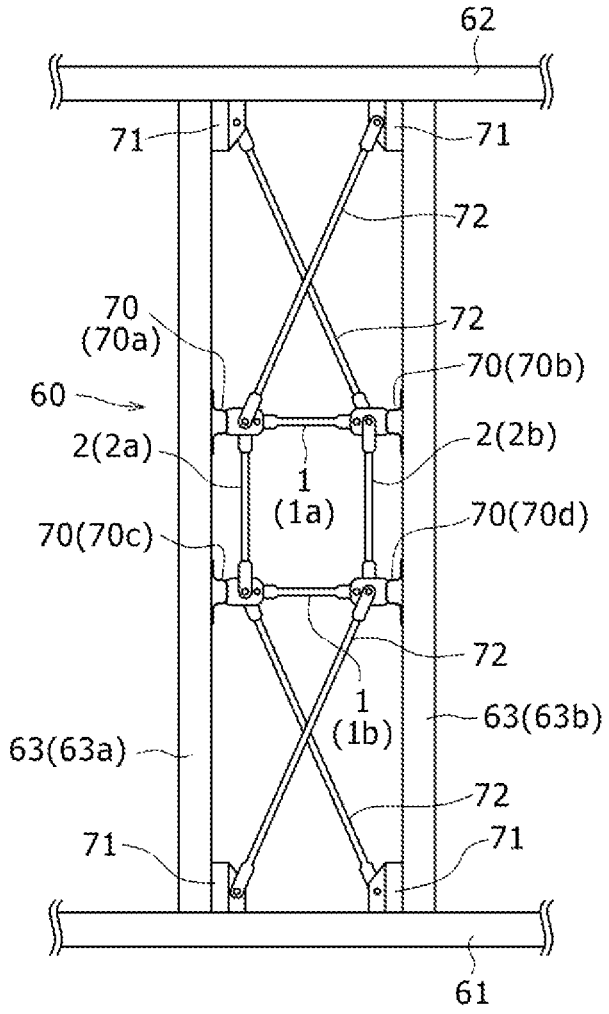
FIG. 1 is a front elevational view illustrating a vibration damping wall structure and a method of connecting vibration damping devices according to a first embodiment of the present invention.

For the first embodiment, FIG. 1 illustrates a vibration damping wall structure and a method of connecting vibration damping devices according to the present invention.

Figure 6:
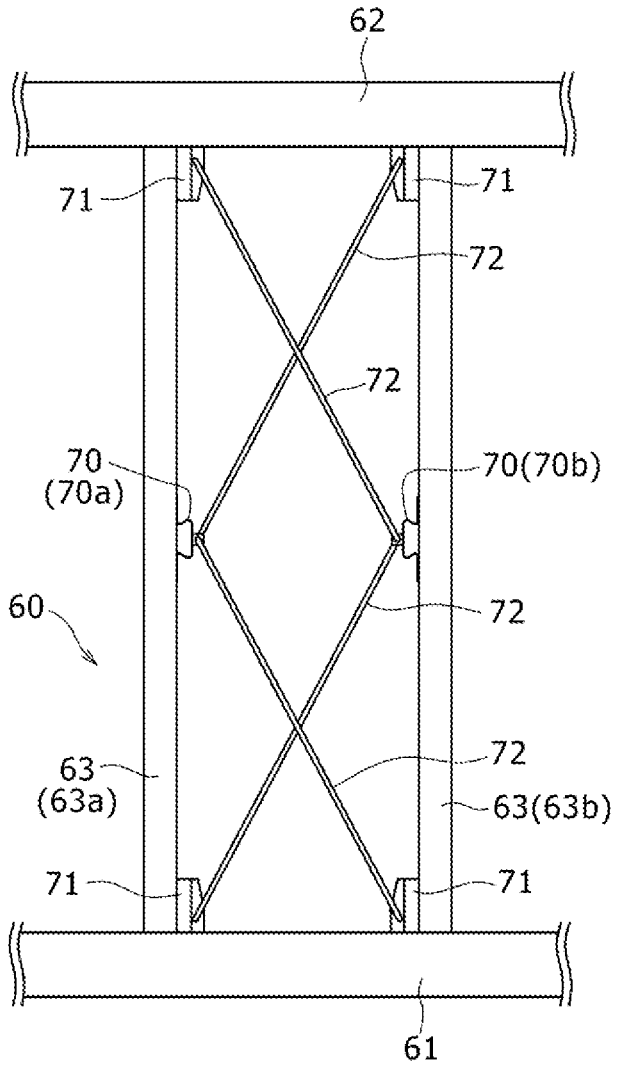
FIG. 6 is a view illustrating an existent example of a vibration damping wall structure and a method of connecting vibration damping devices.
Figure 7:
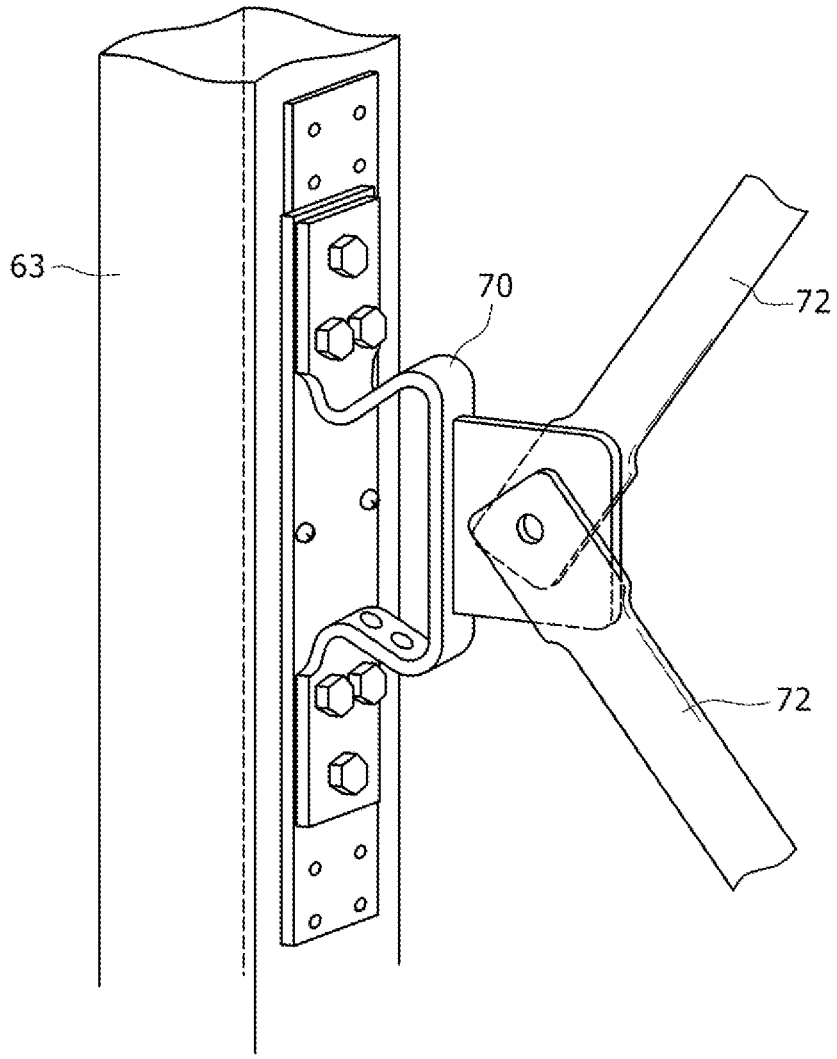
FIG. 7 is a view illustrating a connection portion of the vibration damping device.

Since FIG. 1 shows a lot of constitutional elements that are identical with those of FIG. 6 explained as the prior art, identical reference numerals are used for identical constitutional elements and only the differences are to be explained.

This embodiment has a constitution as illustrated in FIG. 1, which is different from the existent embodiment in FIG. 6 with respect to the followings.

(1) Vibration damping devices are provided each by one on the right and left not but provided each by two on the right and left. It is assumed here that the vibration damping device provided to an upper portion of a vertical member 63*a* is referred to as a damping device 70*a*, a vibration damping device provided at a lower portion of the vertical member 63*a* is referred to as a vibration damping device 70*c*, a vibration damping device provided to the upper portion of a vertical member 63*b* is referred to as a vibration damping device 70*b*, and a vibration damping device provided at a lower portion of the vertical member 63*b* is referred to as a fourth vibration damping device 70*d*.

(2) The vibration damping device 70*a* and the vibration damping device 70*b* are connected by a lateral connection member 1*a*, and the vibration damping device 70*c* and the vibration damping device 70*d* are connected by a lateral connection member 1*b*.

(3) The vibration damping device 70*a* and the vibration damping device 70*c* are connected by a vertical connection member 2*a*, and the vibration damping device 70*b* and the vibration damping device 70*d* are connected by a vertical connection member 2*b*.

Then, a step of connecting the members of the present invention is to be described.

First, as a first step, corner fittings 71 are mounted to corners of the structural plane that constitutes the structural frame 60 of a building respectively and, subsequently, the vibration damping device 70*a* is attached to a first vertical member 63*a* by about 250 mm to 500 mm above the center of the first vertical member 63*a*. The vibration damping device 70*b* is attached to the second vertical member 63*b* at a position opposing thereto. The vibration damping device 70*c* is attached to the first vertical member 63*a* at a position about 250 mm to 500 mm below the center of the first vertical member. The vibration damping device 70*d* is attached to the second vertical member 63*b* at a position opposing thereto.

As a second step, crossing steel pipe braces (braces 72) are attached to upper and lower stages of the structural plane each at a position between each of the corner fittings 71 and each of the vibration damping devices 70.

As a third step, the vibration damping device 70*a* and the vibration damping device 70*b* are connected by the lateral connection members 1*a* and the vibration damping device 70*c* and the vibration damping device 70*d* are connected by the lateral connection members 1*b* respectively. Further, the vibration damping device 70*a* and the vibration damping device 70*c* are connected by the vertical connection member 2*a* and the vibration damping device 70*b* and the vibration damping device 70*d* are connected by the vertical connection member respectively.

As a fourth step, after adjusting the plumbing of the structural plane, connection points are tightly connected by high tension bolts and nuts thereby providing a vibration damping wall structural plane.

Then, the function and the effect of the first embodiment are to be described with reference to FIG. 2.

Figure 2:
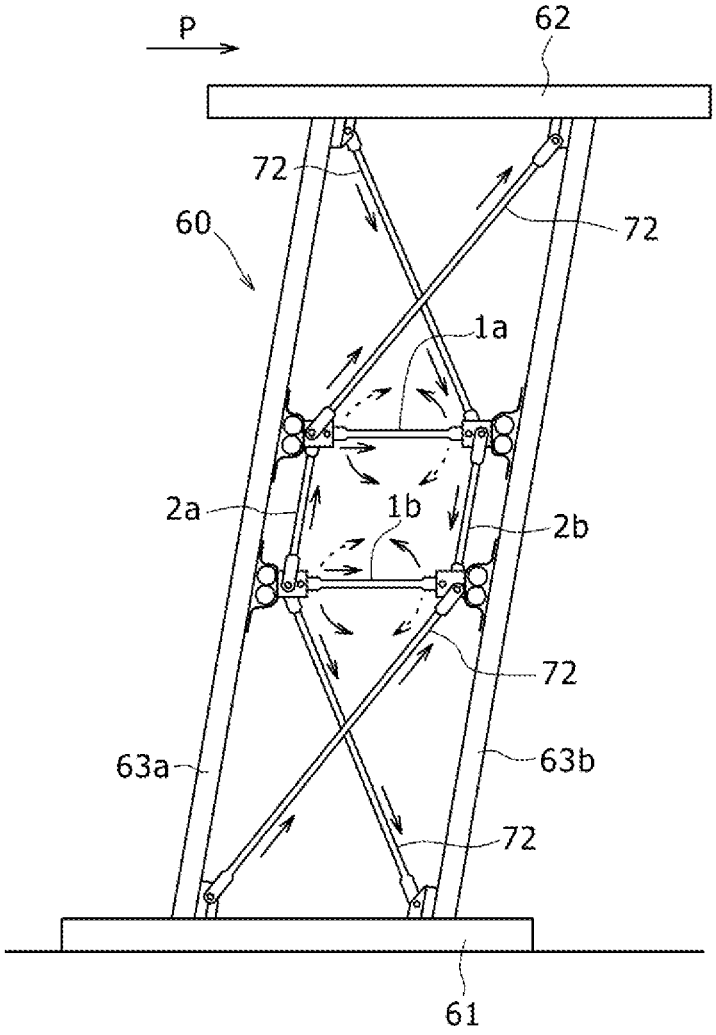
FIG. 2 is a front elevational view illustrating a mode of transmitting earthquake shaking.

In FIG. 2, stress of an earthquake force is transmitted from the first vertical member 63*a* and the second vertical member 63*b* through the upper brace member 72 (upper cross steel pipe brace member) and the lower brace member 72 (lower cross steel pipe brace member) to the lateral connection members 1.

In this condition, the lateral connection member 1*a* operates in a mode like crank movement by vertical sliding of each of the vibration damping devices 70*a* and 70*b* in the direction of the height of the structure plane.

Figure 4:
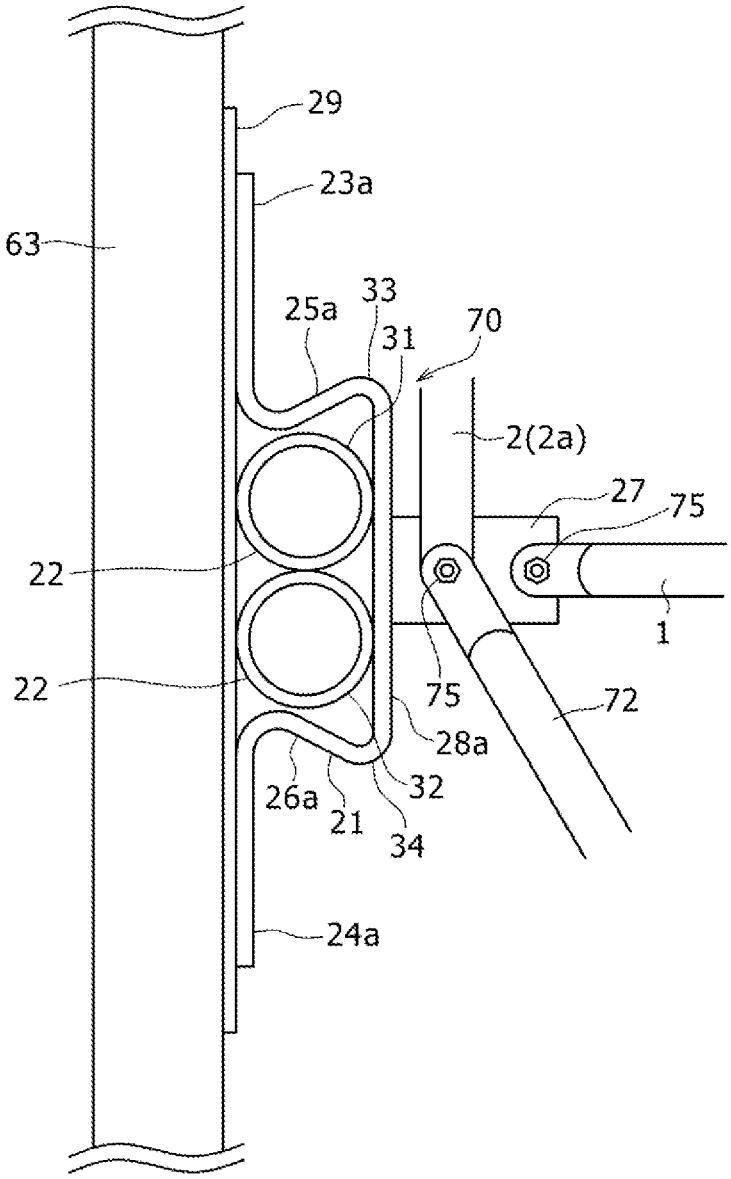
FIG. 4 is a front elevational view of a damping device of a substantially Ω-shaped configuration.

Thus, the lateral connection member 1*a* restricts excess deformation of the upper plane 28*a* by sliding like a piston movement while pressing the upper plane of the vibration damping devices 70 downward upon forward pressing and pulling upward the upper plane upon backward pressing (sliding only for a relative position without changing an absolute distance in the upper plane) (FIG. 4).

Accordingly, excess deformation of the vibration damping device 70 can be restricted to a necessary and sufficient extent even when the support member 22 (FIG. 4) is not present and the bearing performance can also be enhanced while improving the vibration damping performance.

The restrictive phenomenon described above is due to the crank movement of the lateral connection members.

As described above, the stress exerting from the brace member 72, and the vertical connection member 1 and the lateral connection member 2 to extensions thereof by the continuous sliding of the upper plane 28*a* (28*b*) (FIG. 4) of the vibration damping device does not converge to a point since the lateral side bend portion 74 (FIGS. 8A-8C) as a fulcrum of stress transmission moves vertically and right to left like a roller.

By the remarkable effect of dispersing the stress exerted from the brace member 72, and the vertical connection member 1 and the lateral connection member 2 over a wide range of a bottom plate 29 of the vibration damping device 70, the reaction caused by an excessive earthquake force is received substantially uniformly over the entire bottom area of the bottom plate 29 and, as a result, damages that may likely to occur by bending deformation of the vertical member 63 to the the vibration damping device attached at about the center of the vertical member 63 of the structural plane frame of the building can be prevented effectively.

Meanwhile, the sliding movement of the vibration damping devices 70*a* and 70*b* brings about vertical movement of the vertical connection members 2*a* and 2*b*. The vibration damping devices 70*c* and 70*d* also operate simultaneously to induce the crank movement of the lateral connection member 1*b* thereby causing the damping phenomena described above to reliably restrict the excess deformation of the vibration damping device 70 by co-operation of upper and lower vibration damping devices, so that the vibration damping effect can be improved and bearing performance can be enhanced.

Figure 3:
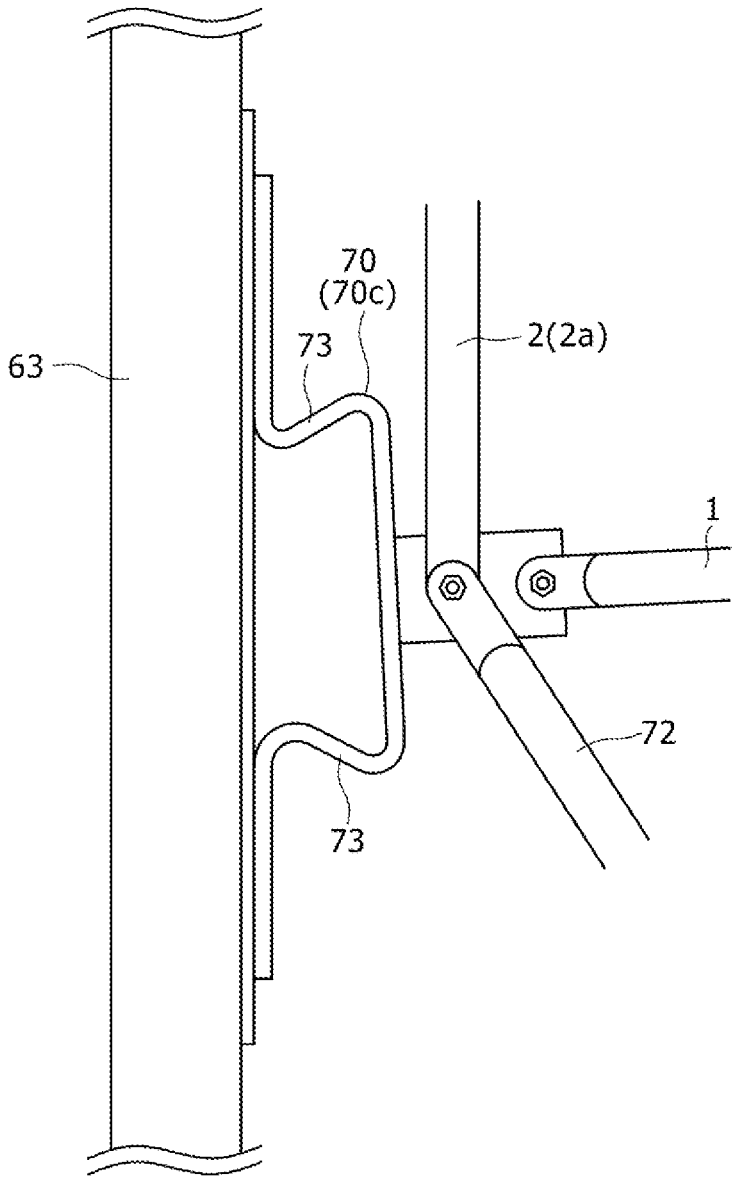
FIG. 3 is a view illustrating a state where a vibration damping device absorbs earthquake shaking.
Figure 8A:
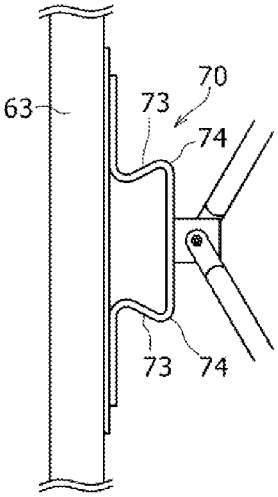
FIGS. 8A-8C are views illustrating a state that the vibration damping device absorbs earthquake shaking.
Figure 8B:
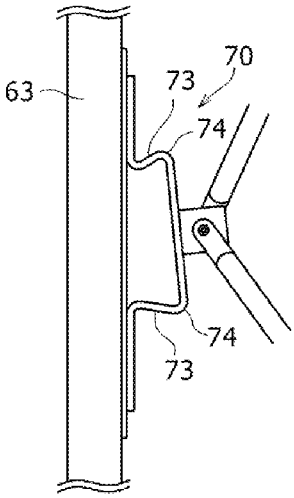
Figure 8C:
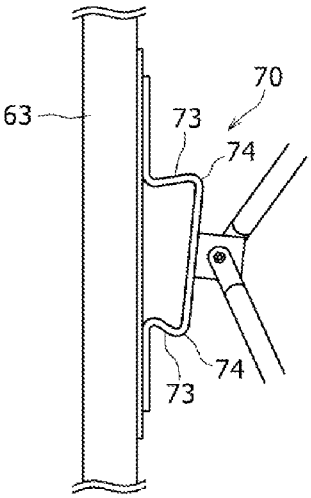

As described above, since the earthquake force is transmitted further uniformly to the vibration damping devices 70 entirely, expansion and contraction of the lateral sides 73 are decreased further (FIG. 3) compared with those in FIGS. 8A-8C, a risk of damaging the vibration damping device 70 by plastic cracks can be decreased further and, in addition, destruction of the vertical member 63 can be decreased remarkably. The material and the shape of the lateral connection member 1 and the vertical connection member 2 may be identical with those of the brace member 72, or they may comprise other rod-like members.

Then, the vibration damping device 70 is to be described specifically. The vibration damping device 70 includes two types depending on whether the device has a support member 22 or not. In this embodiment, a vibration damping device of a type having the support member 22 is to be described specifically. FIG. 4 illustrates a substantially Ω-shaped vibration damping device 70 having a support member 22. The substantially Ω-shaped vibration damping device 70 comprises a vibration damping element 21 made of a low yield point steel and a support member 22 for supporting the vibration damping element 21.

The vibration damping element 21 comprises a steel strip that causes plastic deformation when undergoing a stress beyond an elastic limit and has a first attaching plane 23*a* and a second attaching plane 24*a* for attachment to a vertical member 63, a first rising portion 25*a* rising from the inner end of the first attaching plane 23*a*, a second rising portion 26*a* rising from the inner end of a second attaching plane 24*a*, and an upper plane 28*a* that connects the first rising portion 25*a* (lateral side 25*a*) and a second rising portion 26*a* (lateral side 26*a*) and receives an earthquake shaking transmitted from the structural frame 60 by way of a brace member 72 and an attaching plate 27. The vibration damping element 21 absorbs earthquake shaking as shown in FIG. 8B and FIG. 8C, thereby improving the earthquake resistance of a building.

The support member 22 is a cylindrical member. That is, the support member 22 has a first arcuate lateral side 31 and a second arcuate lateral side 32 and is disposed in a space surrounded by an upper plane 28*a*, the first rising portion 25*a* and the second rising portion 26*a*. The first lateral side 31 is disposed in the inside near the first bend portion 33 formed of the first rising portion 25*a* and the upper plane 28*a*, and the second lateral side 32 is disposed in the inside near a second bend portion 34 formed of the second rising portion 26*a* and the upper plane 28*a*.

By the provision of the support member 22, when an earthquake shaking is transmitted to the vibration damping device 21, excess deformation of the first bend portion 33 and the second bend portion 34 is supported and restricted more reliably by the support member 22 and, accordingly, damages of the vibration damping device 70 caused by generation of plastic cracks can be prevented.

Figure 5:
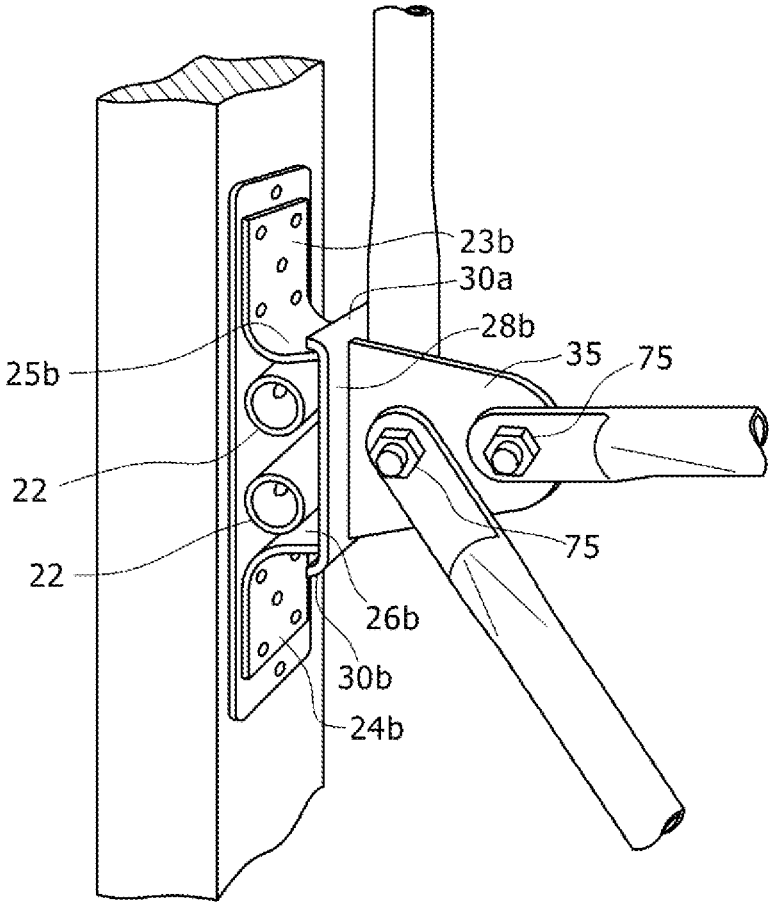
FIG. 5 is a perspective view of a vibration damping device of a substantially π-shaped configuration.

FIG. 5 illustrates a substantially π-shaped vibration damping device 70.

The constitution of the substantially π-shaped vibration damping device 70 is similar to that of the substantially Ω-shaped vibration damping device 70 in FIG. 4, but is different therefrom with respect to the following points. That is, in the substantially π-shaped vibration damping device 70, each of a first rising portion 25*b* and a second rising portion 26*b* is formed by bending a steel strip made of low yielding point steel into a substantially L-angled shape being rounded at a corner, and fixed on the bottom plate 29 such that angled edges are outwarded and opposed at a predetermined distance.

Compared with the substantially Ω-shaped vibration damping device, since the π-shaped vibration damping device 70 has only two opposed portions (first rising portion 25*b* and the second rising portion 26*b*) formed by bending the lower portions, earthquake shaking is directly transmitted to the opposed portions. Accordingly, the device of this type has an advantage that the first rising portion 25*b* and the second rising portion 26*b* can be deformed simply and, on the other hand, the support member 22 has to be mounted for restricting excess deformation. Excess deformation less occurs by so much as the shape is simple and short.

On the other hand, the upper plane 28*b* is made of common steel (SS330•SS400•SS540, etc.) and has a constitution of intending to exclusively rely on the rigidity and the strength of the upper plane for firmly holding an attaching plate 35 that fixes chord members such as the brace member 72, the lateral connection member 1, the vertical connection member 2, etc. Then, for making the joint with the L-shaped angle member more firmly, each of the top ends is hooked in the direction of the first attaching plane 23*b* and the second attaching 24*b*.

Second Embodiment

A second embodiment describes an example of a vibration damping wall structure and a method of connecting vibration damping devices.

Figure 9:
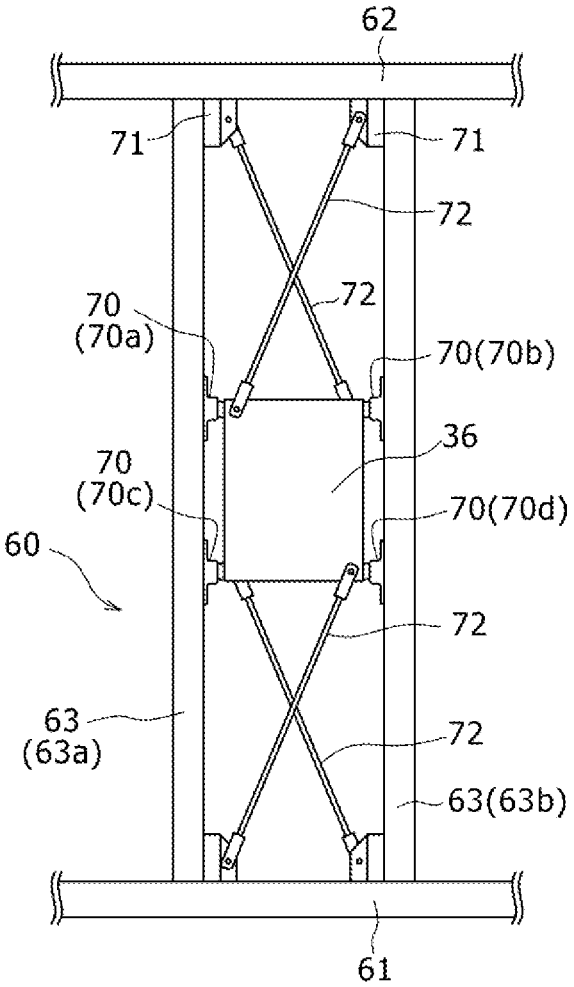
FIG. 9 is a front elevational view illustrating a vibration damping wall structure and a method of connecting vibration damping devices according to a second embodiment of the present invention.

In this embodiment, FIG. 9 illustrates a vibration damping wall structure and a method of connecting vibration damping devices according to the present invention.

Since FIG. 9 shows a lot of constitutional elements that are identical with those of FIG. 1 explained as the first embodiment, identical reference numerals are used for identical constitutional elements and only the differences are to be explained.

The second embodiment has a constitution as illustrated in FIG. 9, which is different from the first embodiment (shown in FIG. 1) in that the vibration damping devices 70 are connected not by the lateral connection member 1 and the vertical connection member 2 but by a connection plate member 36 comprising a structural plywood or a metal plate or a composite plate integrally.

The connection plate member 36 is joined at each of corners to an attaching plate 27 of a vibration damping device 70 by means of high tension bolts 75 and nuts in the same manner as in the case of the lateral connection member 1 and the vertical connection member 2 of the first embodiment. In the first embodiment, a rectangular frame of an instable structure is formed by the lateral connection member 1 and the vertical connection member 2, which tends to be deformed into a parallel piped shape following the deformation of the building upon exertion of an earthquake force. On the other hand, in the second embodiment, the connection plate member 36 per se is a plate member having a large in-plane rigidity, which repeats rotational movement swinging right and left while keeping a quadrangular shape following the sliding movement of the upper plane 28 of the vibration damping device 70 due to deformation of the building upon exertion of the earthquake force.

Next, the function and the effect of this embodiment are to be described with reference to FIG. 10.

Figure 10:
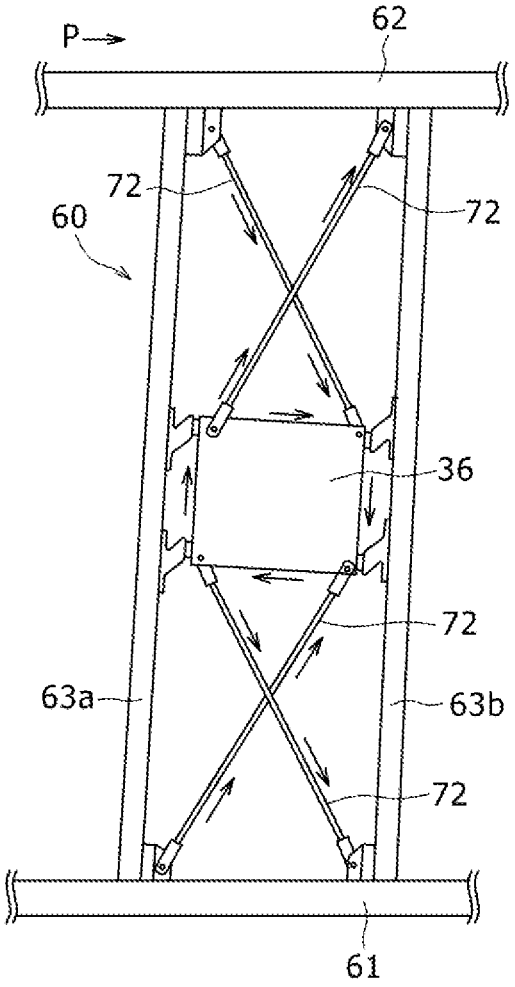
FIG. 10 is a front elevational view illustrating a transfer mode of earthquake shaking in the second embodiment.

In FIG. 10, stress of an earthquake force is transmitted from the first vertical member 63*a* and the second vertical member 63*b* by way of the upper brace member 72 (upper cross steel pipe brace) and the lower brace member 72 (lower cross steel pipe brace) by way of the vibration damping devices 70 to the connection plate member 36.

In this condition, the connection plate member 36 moves vertically and right to left by vertical sliding movement of the upper planes 28*a* and 28*b* of each of the vibration damping devices 70*a* and 70*b* in the direction of the height of the wall plane (vertical direction).

Thus, since the connection plate member 36 slides the upper planes 28*a* and 28*b* of the vibration damping devices 70 while pressing downward upon forward pressing and pulling the upper planes upward upon backward pressing (sliding only for a position without changing an absolute distance between the upper planes).

Accordingly, excess deformation of the vibration damping device 70 is restricted to a necessary and sufficient extent and also the bearing performance can be enhanced while improving the vibration damping performance even when the support member 22 (FIG. 4) is not present in the same manner as in the first embodiment. The damping phenomenon described above is due to the action of the connection plate member 36.

Figure 11:
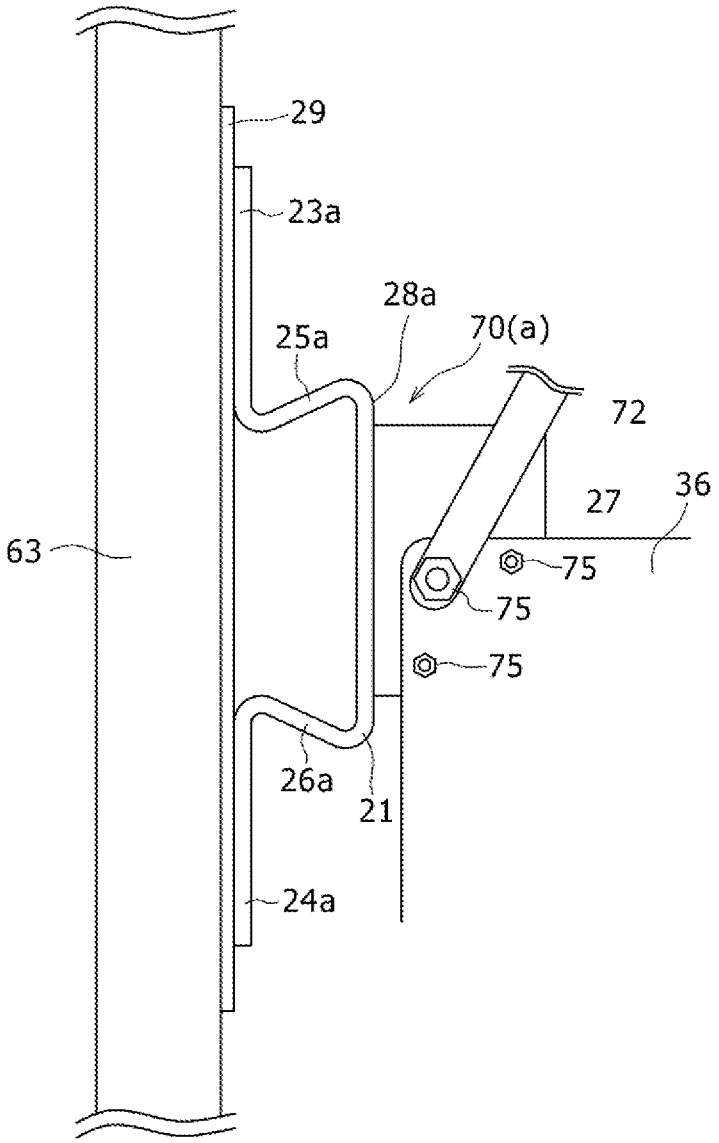
FIG. 11 is a view illustrating a state of attaching a vibration damping device and a connection plate of the second embodiment.

As described above, stress exerting from the brace member 72 and the connection plate member 36 to the extensions thereof by continuous sliding of the upper plane 28*a* of the vibration damping device (FIG. 11) does not converge to a point since the lateral side bend portion 74 (FIG. 8) moves vertically and right to left following the sliding movement like a roller in the same manner as in the first embodiment.

Accordingly, by the remarkable effect that the stress exerting from the brace member 72 and the connection plate member 36 to the extensions thereof less converges to a point of the vertical member 63 of the building structure frame but disperses over a wide range of the bottom plate 29 of the vibration damping device 70, the reaction caused by an excessive earthquake force is dispersed at random over the entire bottom of the bottom plate 29 and, as a result, damages caused by the bending deformation of the vertical member 63 that tends to be formed in the vibration damping device attached near the central portion of the vertical member 63 of the structural wall frame of the building can be prevented effectively.

On the other hand, the sliding movement of the upper plane 28*a* of the vibration damping device 70*a* and the upper plane 28*b* of the vibration damping device 70*b* brings about a vertical movement of the connection plate member 36 in the longitudinal direction (vertical direction), in which the vibration damping devices 70*c* and 70*d* operates simultaneously thereby inducing the lateral (horizontal) rotational action of the connection plate member 36, which can control the over deformation of the vibration damping device 70 reliably by the cooperation of the upper and lower vibration damping devices 70, thereby improving the vibration damping performance and enhancing the bearing performance.

As described above, upon occurrence of an earthquake, since the action thereof is transmitted entirely by the vibration control devices 70 and the connection plate member 36 more uniformly, expansion and contraction of the lateral side 73 are decreased compared with those in the prior art (FIGS. 8A-8C), and the risk of damaging the vibration damping device 70 by plastic cracks can be decreased further. As a result, destruction of the vertical member 63 of the building structural frame 60 by the damages of the vibration damping device 70 can be avoided and the earthquake energy can be absorbed and decayed effectively.

In addition, for the connection plate member 36, it is not particularly necessary to provide a plate member designed previously to a prescribed size and the connections plate member 36 sized in situ depending on the condition of the spot can be manufactured and assembled and the cost can be decreased.

DESCRIPTION OF REFERENCE SIGNS

P external force
1*a*, 1*b* lateral connection member
2*a*, 2*b* vertical connection member
21 vibration damping element
22 support member
23*a*, 23*b* first attaching plane
24*a*, 24*b* second attaching plane
25*a*, 25*b* first rising portion
26*b*, 26*b* second rising portion
27 attaching plate
28*a*, 28*b* upper plane
29 bottom plate
31 first lateral side
32 second lateral side
33 first bend portion
34 second bend portion
35 attaching plate
36 connection plate member
60 structural frame
61 foundation
62 beam
63*a*, 63*b* vertical member
70 (70*a*, 70*b*, 70*c*, 70*d*) vibration damping device
71 corner fitting
72 brace member
73 lateral side
74 Bend portion of lateral side
75 high tension bolt

What is claimed is:

1. A vibration damping wall structure including:

a plurality of first vibration damping devices attached to a first vertical member that constitutes a structural frame of a building, a plurality of second vibration damping devices attached to a second vertical member that constitutes the structural frame so as to oppose the first vibration damping devices, a plurality of first brace members for connecting the first vertical member and the second vibration damping devices, a plurality of second brace members for connecting the second vertical member and the first vibration damping devices, lateral connection members for connecting the first vibration damping devices and the second vibration damping devices opposing the first vibration damping devices, a first vertical connection member for connecting the plurality of the first vibration damping devices to each other and a second vertical connection member for connecting the plurality of the second vibration damping devices to each other.

2. The vibration damping wall structure according to claim 1, wherein the first vibration damping device or the second vibration damping device has a vibration damping element constituted with a steel strip that deforms plastically when an exerting force exceeds a limit of elasticity, and the vibration damping element comprises a first attaching plane and a second attaching plane for attachment to the first vertical member or the second vertical member, a first rising portion that rises from the inner end of the first attaching plane, a second rising portion that rises from the inner end of the second attaching surface, and an upper plane for connecting the first rising portion and the second rising portion and receiving an earthquake shaking transmitted from the structural frame by way of a brace member attaching plate.

3. The vibration damping wall structure according to claim 2, wherein the first vibration damping device or the second vibration damping device has a vibration damping element support member for supporting the vibration damping element, the vibration damping element support member comprises a first arcuate lateral side and a second arcuate lateral side, and is disposed in a space surrounded by the upper plane, the first rising portion and the second rising portion of the vibration damping element, the first lateral side is disposed near the inside of the first bend portion formed of the first rising portion and the upper plane, and the second lateral side is disposed near the inside of the second bending portion formed of the second rising portion and the upper plane.

4. The vibration damping wall structure according to claim 2, wherein both end portions of the upper plane protrude to the outside of the first rising portion and the second rising portion.

5. The vibration damping wall structure according to claim 4, wherein the both end portions of the upper plane are bent in the direction of the first attaching plane and the second attaching plane respectively.

6. A method of connecting a plurality of first vibration damping devices attached to a first vertical member that constitutes a structural frame of a building, and a plurality of second vibration damping devices attached to a second vertical member that constitutes the structural frame so as to oppose the first vibration damping device, the method including:

connecting the first vertical member and the second vibration damping devices by a plurality of first brace members, connecting the second vertical member and the first vibration damping devices by a plurality of second brace members, connecting the first vibration damping devices and the second vibration damping devices opposing the first vibration damping devices by lateral connection members respectively, connecting the plurality of the first vibration damping devices to each other by a first vertical connection member, and connecting the plurality of the second vibration damping devices to each other by a second vertical connection member.

7. A vibration damping wall structure including:

a plurality of first vibration damping devices attached to a first vertical member that constitutes a structural frame of a building, a plurality of second vibration damping devices attached to a second vertical member that constitutes the structural frame so as to oppose the first vibration damping devices, a plurality of first brace members for connecting the first vertical member and the second vibration damping devices, a plurality of second brace members for connecting the second vertical member and the first vibration damping devices, and a connection plate member for connecting the plurality of the first vibration damping devices and the plurality of the second vibration damping devices.

8. A method of connecting a plurality of first vibration damping devices attached to a first vertical member that constitutes a structural frame of a building, and a plurality of second vibration damping devices attached to a second vertical member that constitutes the structural frame so as to oppose the first vibration damping device, the method including:

connecting the first vertical member and the second vibration damping devices by a plurality of first brace members, connecting the second vertical member and the first vibration damping devices by a plurality of second brace members, and connecting the plurality of the first vibration damping devices, and the plurality of the second vibration damping devices by a connection plate member.

* * * * *